US006073784A

United States Patent [19]

Hattingh et al.

[11] Patent Number: 6,073,784

[45] Date of Patent: Jun. 13, 2000

[54] SHELVING SYSTEM

[75] Inventors: Peter Hattingh, Hoenersweg, Germany; Richard Peter Rorison Sutherland, Welford-on-Avon, United Kingdom

[73] Assignee: McKechnie UK Limited, United Kingdom

[21] Appl. No.: 09/062,803

[22] Filed: Apr. 20, 1998

[30] Foreign Application Priority Data

Apr. 21, 1997 [GB] United Kingdom ..... 9707983

[51] Int. Cl.[7] ..... A47G 29/02; A47B 96/06

[52] U.S. Cl. ..... 211/90.01; 248/250; 108/152

[58] Field of Search ..... 211/90.01; 248/250, 248/235; 108/108, 152

[56] References Cited

U.S. PATENT DOCUMENTS

| | | | |
|---|---|---|---|
| Re. 27,200 | 10/1971 | Ferdinand et al. | 211/148 |
| 2,477,771 | 8/1949 | Sanford | 248/247 |
| 2,986,366 | 5/1961 | Wesson | 248/250 X |
| 3,173,545 | 3/1965 | La Mar | 211/90.01 X |
| 4,037,813 | 7/1977 | Loui et al. | 248/250 |
| 4,183,487 | 1/1980 | Swain | 248/250 X |
| 4,294,365 | 10/1981 | Henderson | 211/87.01 X |
| 4,300,692 | 11/1981 | Moreno | 211/87.01 X |
| 4,508,301 | 4/1985 | Nicholson et al. | 248/235 X |
| 4,691,887 | 9/1987 | Bessinger | 211/90.01 X |
| 4,738,426 | 4/1988 | Bessinger | 211/90.01 X |
| 4,765,575 | 8/1988 | Bergl et al. | 248/250 |
| 4,783,035 | 11/1988 | Remmers | 248/250 |
| 4,799,643 | 1/1989 | Shepard | 248/250 X |
| 4,821,892 | 4/1989 | Randall | 211/90.01 |
| 4,863,127 | 9/1989 | Handler | 248/250 X |
| 4,871,136 | 10/1989 | Bessinger et al. | 248/250 |
| 4,886,236 | 12/1989 | Randall | 248/250 |
| 4,915,338 | 4/1990 | Guth | 211/90.01 X |
| 5,014,952 | 5/1991 | Petrohilos | 248/250 |
| 5,020,758 | 6/1991 | Rawlyk | 108/152 X |
| 5,044,285 | 9/1991 | Wolfe, III | 108/152 |
| 5,064,158 | 11/1991 | Brazier et al. | 211/90.01 X |
| 5,140,915 | 8/1992 | Knape | 248/250 X |
| 5,197,703 | 3/1993 | Pratolongo | 108/152 X |
| 5,318,176 | 6/1994 | Kaspersen et al. | 211/90.01 X |
| 5,384,198 | 1/1995 | Hodges | 248/235 X |
| 5,396,994 | 3/1995 | Fitzgerald | 211/32 |
| 5,411,144 | 5/1995 | Deupree | 211/30 |
| 5,456,435 | 10/1995 | Sweeney | 248/250 |
| 5,605,238 | 2/1997 | Jacobs | 211/90.01 |
| 5,692,717 | 12/1997 | Glaeser | 248/235 X |
| 5,775,656 | 7/1998 | Roberts et al. | 108/152 X |
| 5,794,902 | 8/1998 | Henry et al. | 211/90.01 X |
| 5,799,803 | 9/1998 | Muller | 211/90.01 |

*Primary Examiner*—Daniel P. Stodola
*Assistant Examiner*—Khoa Tran
*Attorney, Agent, or Firm*—Volpe and Koenig, P.C.

[57] ABSTRACT

The shelving system (1) consists of a bracket (10) with a shelf board (5). The bracket (10) has a slot into which the edge of the shelf board is located. The slot is sized so that the edge of the shelf board fits loosely within the slot. A wedge (30) is provided also for insertion into the slot adjacent the shelf board (5) to secure the shelf board in position within the slot. The wedge (30) is preferably tapered and has a front surface that is contoured to match the contours of the front surface of the bracket. An aperture (not shown) is provided at the back of the slot to receive a fastening device such as a screw etc for securing the bracket to a wall. As the aperture is at the back of the slot the aperture and the fastening device are obscured by the shelf board when in use. The shelving unit is particularly easy to assemble whilst still ensuring the shelf board is securely fitted to the bracket.

12 Claims, 7 Drawing Sheets

10
11
20
21
22
23
25
26
30
31
32
34
35
37
38
40
41
44
45
46
47
70
71
72
73
74

Fig.21.
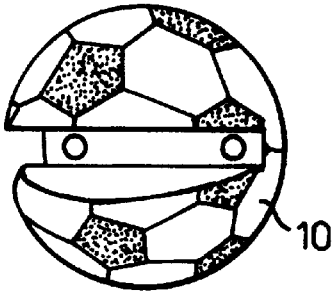
Fig.22.
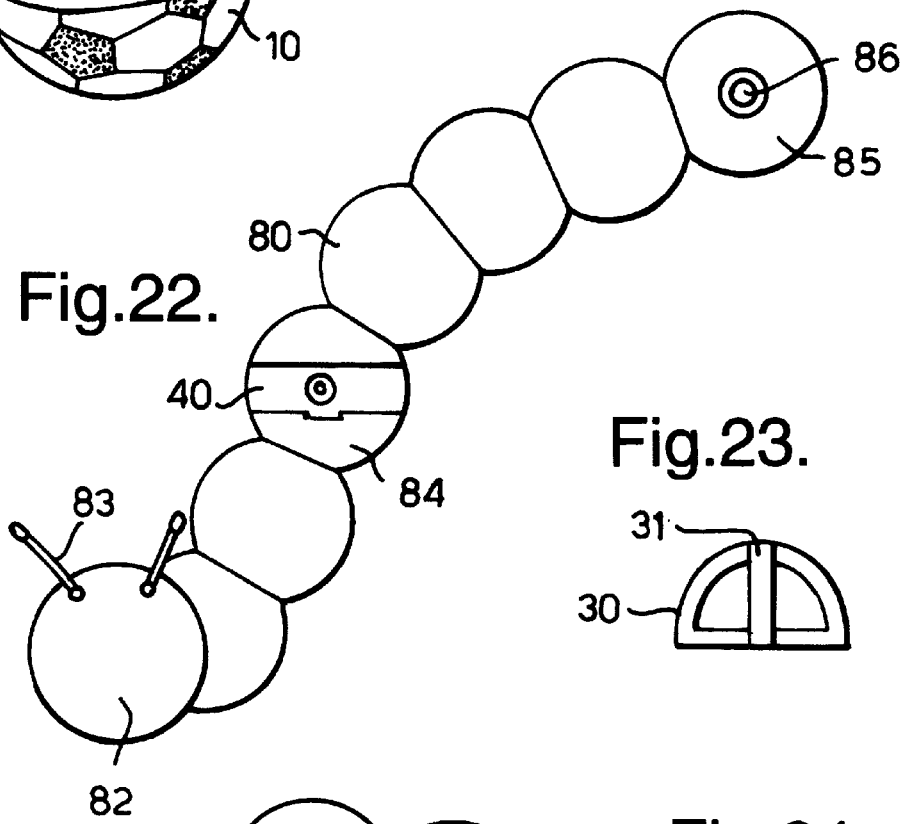
Fig.23.
Fig.24.
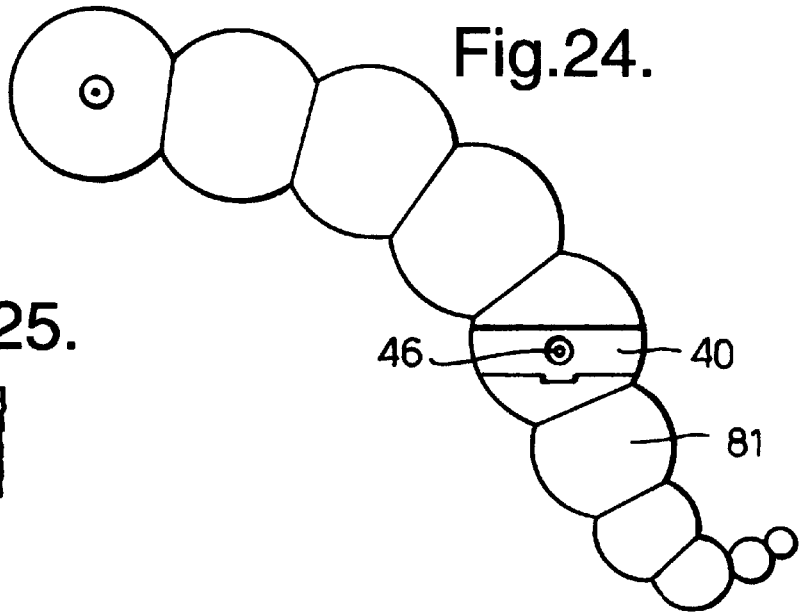
Fig.25.
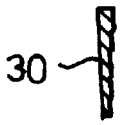

SHELVING SYSTEM

The present invention relates to a shelving system.

There is a requirement for a shelving system which is easy to assemble, secure and decorative, as well as being relatively inexpensive to manufacture.

According to the present invention there is provided a shelving system comprising one or more brackets, the or each bracket comprising a main body having a slot formed therein adapted to loosely receive a shelf board, and an insert adapted for insertion into the slot, in addition to the shelf board whereby the insert acts to hold the shelf board in place.

Such a shelving system is very readily assembled into a shelf unit by an inexperienced assembler. Furthermore, the bracket is generally formed into a decorative shape to satisfy the requirement of an aesthetically pleasing design. An additional advantage of this system is that varying thicknesses of shelf board may be accommodated without having to alter the dimensions of the main part of the bracket, simply by providing inserts having varying thicknesses.

Preferably, the main part of the bracket includes an attachment means for firmly attaching the bracket to a support such as a wall, etc.

The attachment means may take the form of at least one aperture through which the shank of a conventional fastening device such as a screw, nail, or rawl plug, may be driven, and a seat formed around the aperture for receiving the head of the fastening device. Preferably, the attachment moans is formed within the slot so as to be hidden from view when a shelf board is inserted into the slot.

Preferably the insert is formed with one or more locating ridges or grooves and the main part of the bracket is formed with co operating grooves or ridges respectively, formed within the slot. In this way, it is easy to ensure that the insert is correctly fitted. The locating ridges or grooves are preferably longitudinally formed in the direction of insertion of the insert into the slot so as to locate the insert correctly in the slot in the lateral direction transverse to the locating ridges or grooves. There may also be provided further locating ridges, grooves or alternatively shaped, matching projections and recesses which act to locate the insert longitudinally, As well as transversely, within the slot.

Ideally, the insert has an outer perimeter which is shaped to correspond to the cross sectional shape of the main part of the bracket adjacent to the slot, such that the perimeter wall of the insert is flush with the visible external surface or surfaces of the main part of the bracket, when correctly fitted, Preferably, the insert is a wedge tapered so as to have a thin end and a thick end, the longitudinal ridges extending between the thin and thick ends, and the wedge being adapted for insertion into the slot such that the thick end of the wedge follows the thin end.

The slot may also taper inwardly from the entrance of the slot towards the far end of the slot to improve the case with which both the shelf board and the wedge may be fitted into the slot during assembly. It is primarily intended that two or more brackets will be used to support a single shelf board. However, it is also envisaged that a single bracket may be used. In this alternative arrangement, extra support blocks may be used to provide additional support and stability to the shelf board. Each extra support block preferably includes first and second attachment means for attaching the extra support block to the wall on which the assembled shelf unit is to be mounted and to the shelf board respectively, and may additionally include either an underside or a topside support means for supporting either the underside or topside of the shelf board.

Each support block is preferably shaped such that it extends only either above or below the shelf when mounted so as to be substantially invisible from either below or above the shelf unit respectively when assembled and mounted.

In order that the present invention may be better understood, embodiments thereof will now be described, by way of example only, with reference to the accompanying drawings in which:

FIG. 21 is a perspective view of yet another bracket according to to the present invention;

FIG. 22 is a front plan view of a first part of yet another bracket according to the present invention;

FIG. 23 is a side plan view of a wedge for use with the bracket of FIG. 22;

FIG. 24 is a front plan view of a second part of the bracket of FIG. 22;

FIG. 25 is a cross-sectional view of the wedge of FIG. 23; and

Figure 1:
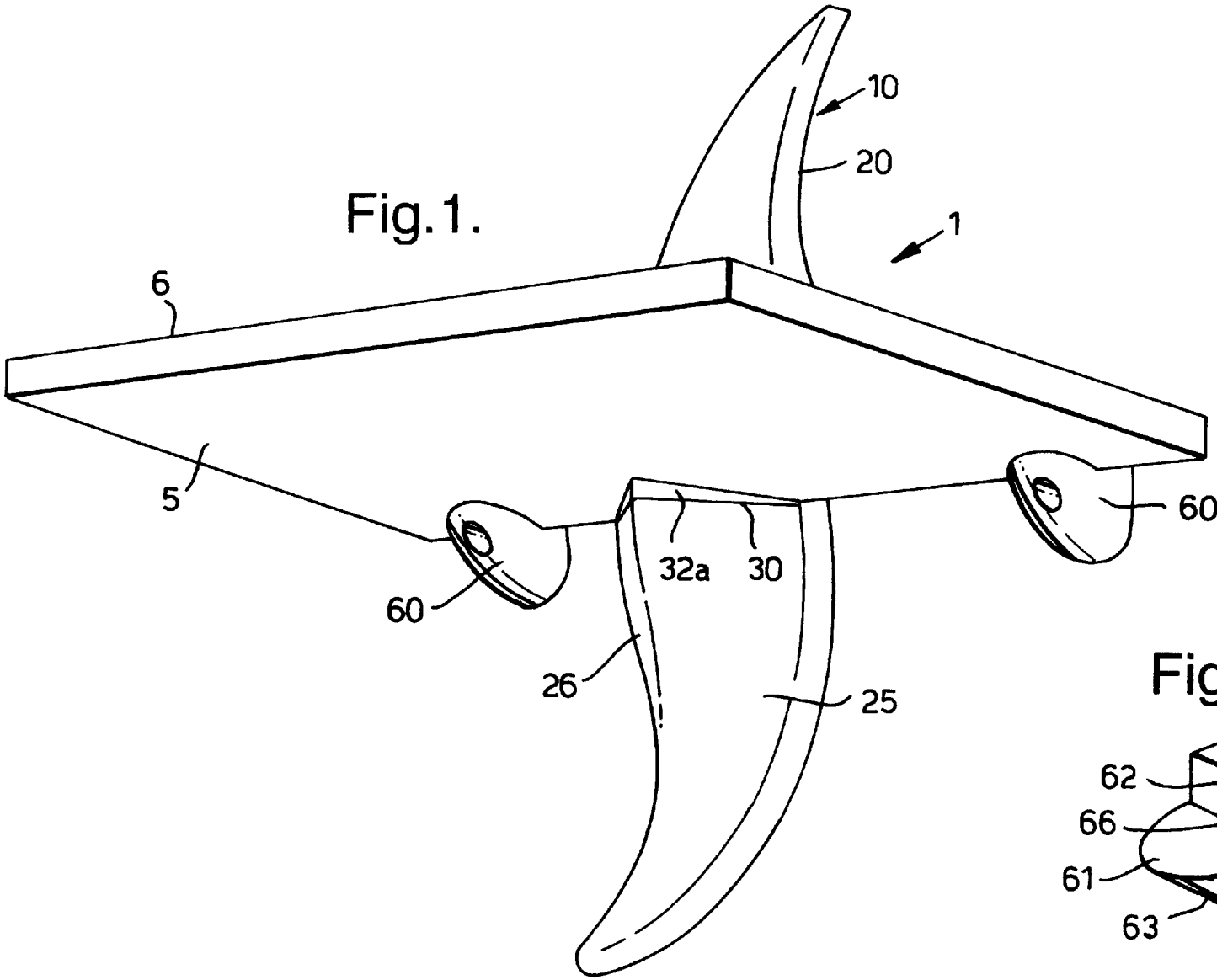
FIG. 1 is a perspective view of an assembled shelf unit according to the present invention.

Referring firstly to FIGS. 1 to 7, the assembled shelf unit 1 comprises a bracket 10 into which is slotted a shelf board 5. The bracket 10 comprises a main part 20 and a wedge 30.

In FIG. 1 a single bracket 10 is shown with two extra support blocks 60 attached to the shelf board 5 on either side of the bracket 10. Of course, an alternative arrangement for providing equally good stability is simply to use two or more of the brackets 10 to support the shelf board 5 in which case the extra support blocks 60 may be omitted.

Figure 2:
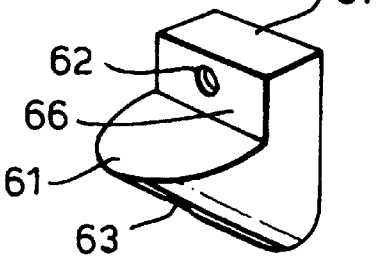
FIG. 2 is a perspective view of one of the extra support blocks shown in FIG. 1.

Referring particularly to FIGS. 1 and 2, each extra support block 60 has an underside support surface 61, a first aperture 62 and a second aperture 63. The first aperture 62 is formed in a short vertical wall 66 and is adapted to receive a fastening means therethrough for attaching the support block 60 to the back edge of the shelf board 5. The short vertical wall 66 has a flat top 67 which lies flush with the top surface 6 of the board 5 when fitted, such that the support block is substantially invisible when the shelf unit 1 is viewed from above. The second aperture 63 is recessed and is similarly adapted to receive a fastening means therethrough for attaching the support block 60 to a wall or similar surface on which the shelf unit is to be mounted. Any conventional suitable fastening means may be used such as a screw, nail or rawl plug, as appropriate.

Referring now to FIGS. 3 to 7 in particular, each bracket 10 is ideally formed from moulded, rigid plastics material with the wedge 30 attached to the main part 20 via a frangible tab 11. which is snapped off prior to assembly of the shelf unit 1. Alternatively, the wedge 30 could be separately moulded to provide wedges 30 having different thicknesses, so as to accommodate different thicknesses of shelf board 5, without having to alter the main part 20 of the bracket 10.

A slot 40 is formed in the bracket 10 so as to leave upper 41 and lower 70 jaws. The slot 40 tapers inwardly away from the entrance 44 to the slot towards the closed end 45 of the slot. At the closed end 45 of the slot 40 a single fixing aperture 46 is formed through which a conventional fastening means may be driven to secure the bracket 10 to the wall, etc. on which the shelf unit is to be mounted. A recessed seat 47 is formed around the aperture 40 to receive the head of the fastening means.

The main part 20 of the bracket 10 is substantially hollow, with a rearwardly facing surface 21 provided around the perimeter 22 of the main part 20 for locating against the wall, etc. on which the shelf unit is to be mounted. A rigid strip 23 of plastics material is formed across the centre of the main part 20 of the bracket 10 to form the closed end 45 of the slot 40 in which the single fixing aperture 46 is formed. Further struts or pillars in may also be formed within the main part 20 of the bracket 10 to give the bracket extra rigidity and strength.

Figures 3, 4, 5, 6, 7:
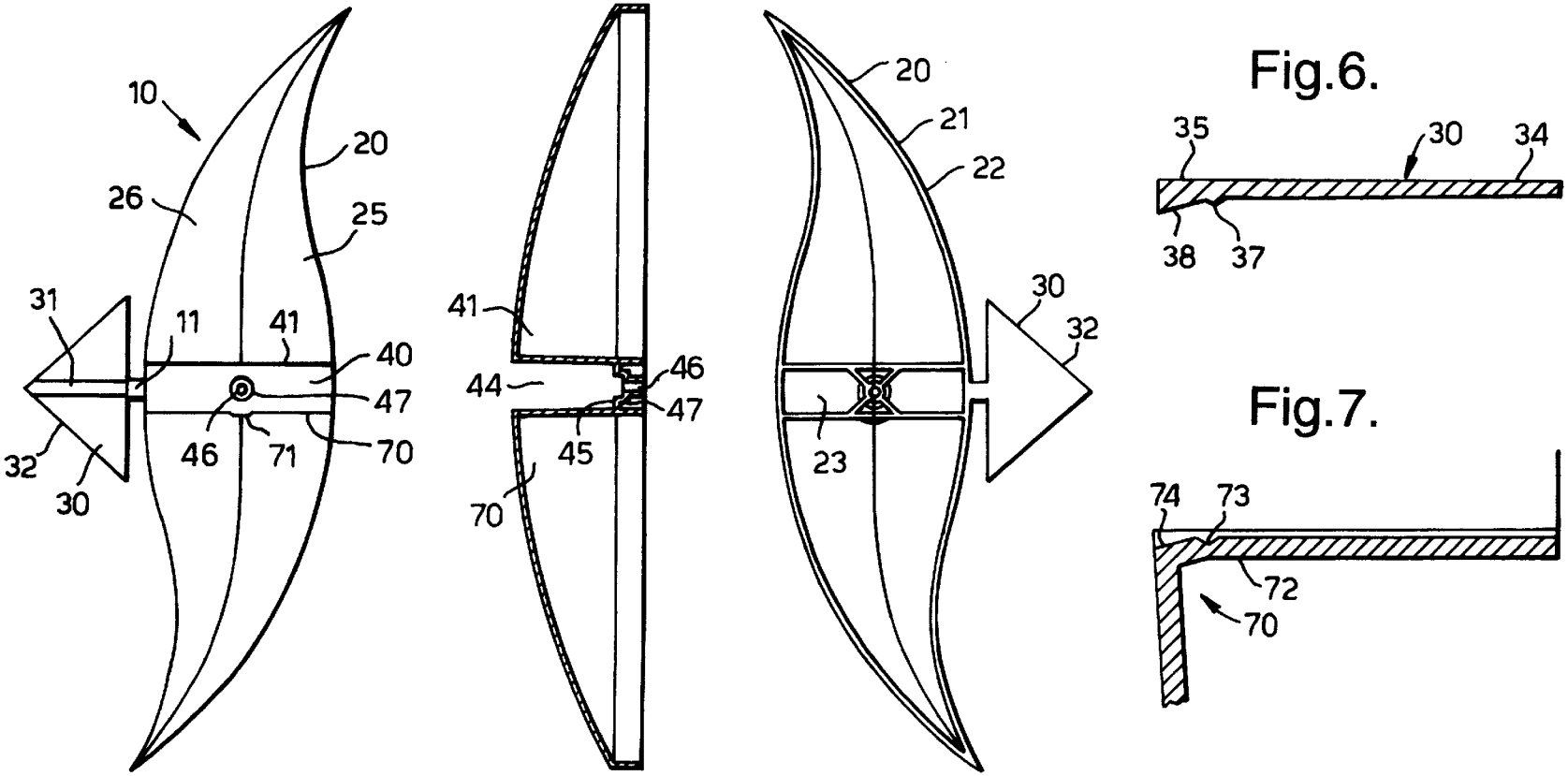
FIG. 3 is a front plan view of the bracket shown in FIG. 1.
FIG. 4 is a cross-sectional side view of the bracket shown in FIG. 3.
FIG. 5 is a rear plan view of the bracket shown in FIG. 3.
FIG. 6 is an expanded cross-sectional side view of the wedge of the bracket shown in FIG. 3.
FIG. 7 is an expanded cross-sectional side view of the lower jaw of the bracket shown in FIG. 3.
Figure 8:
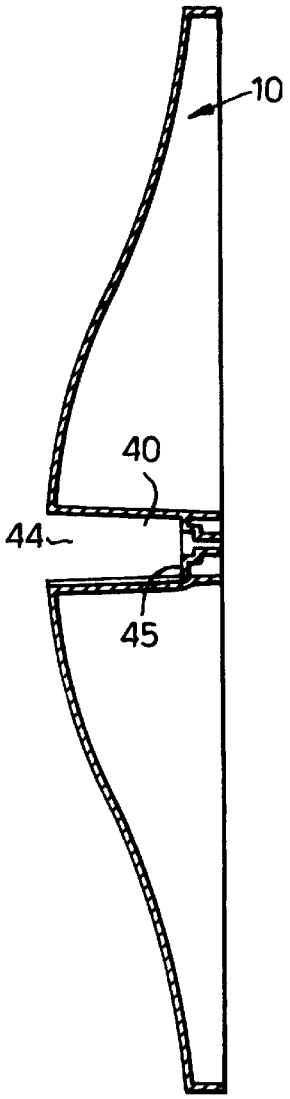
FIG. 8 is a cross-sectional side view of an alternative bracket according to the present invention.
Figure 9:
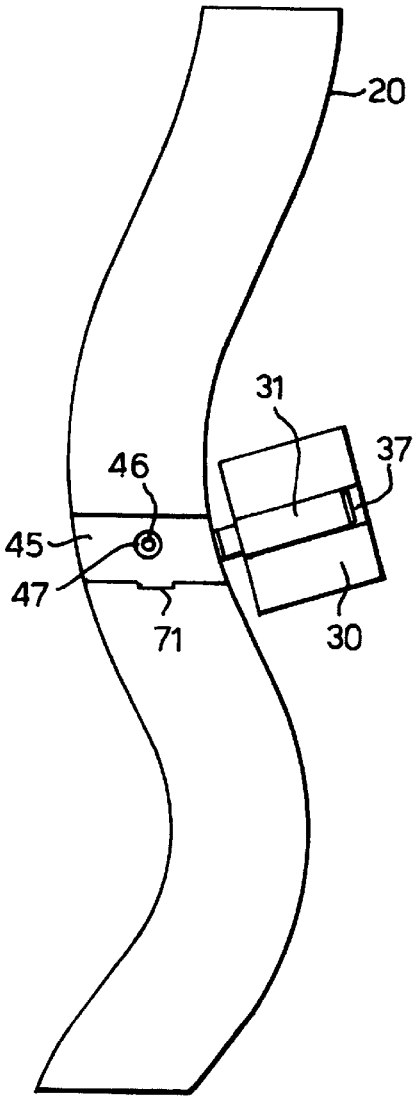
FIG. 9 is a front plan view of the bracket shown in FIG. 8.
Figure 14:
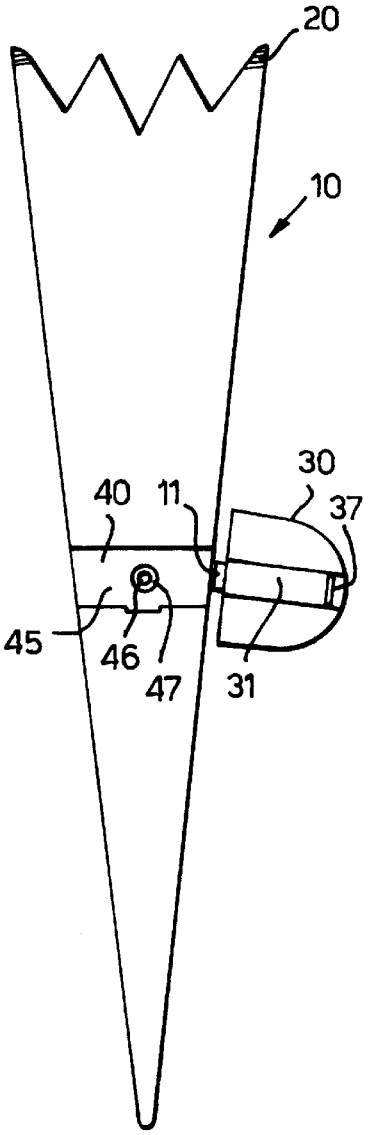
FIG. 14 is a front plan view of yet another bracket according to the present invention.
Figure 10:
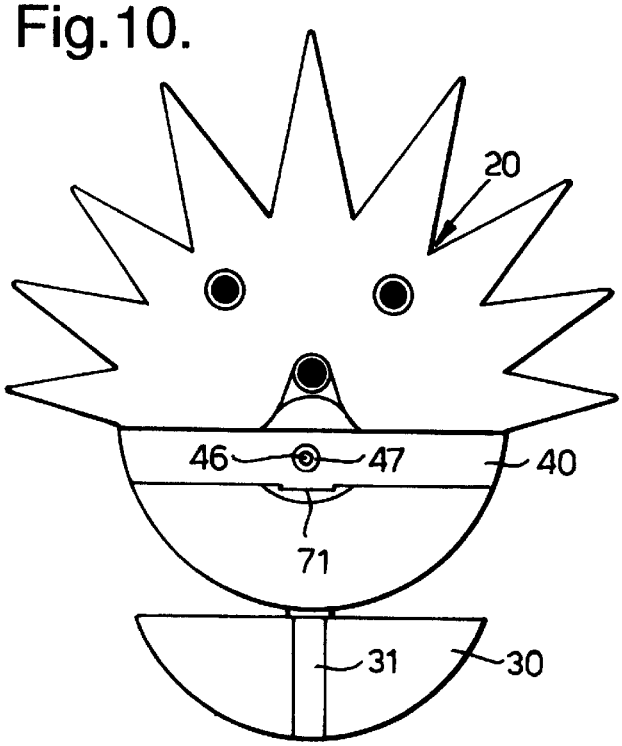
FIG. 10 is a front plan view of another alternative bracket according to the present invention.
Figure 11:
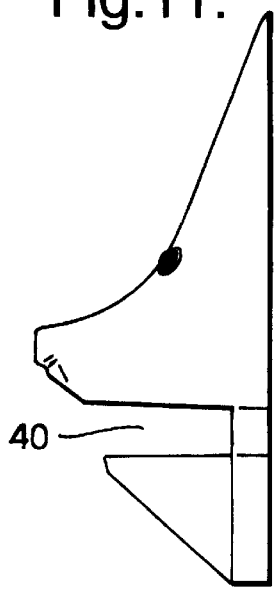
FIG. 11 is a side plan view of the bracket shown in FIG. 10.
Figure 12:
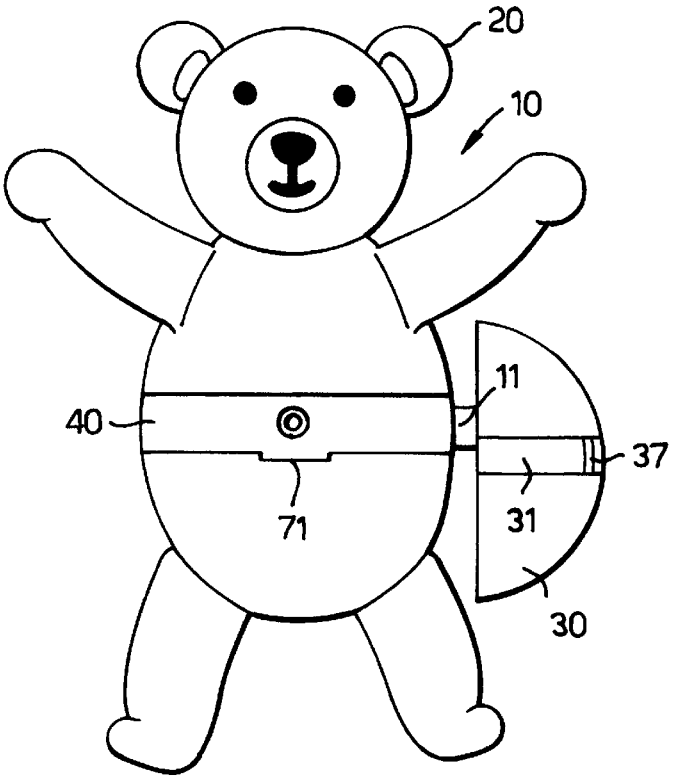
FIG. 12 is a front plan view of yet another bracket according to the present invention.
Figure 13:
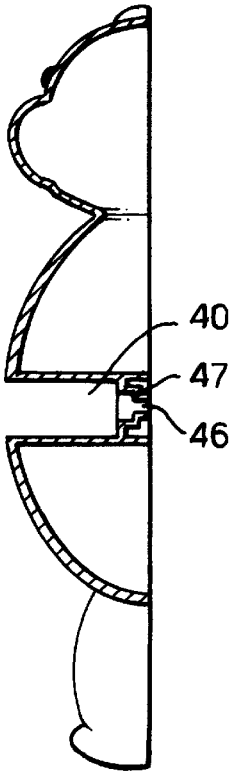
FIG. 13 is a cross-sectional side view of the bracket shown in FIG. 12.
Figure 15:
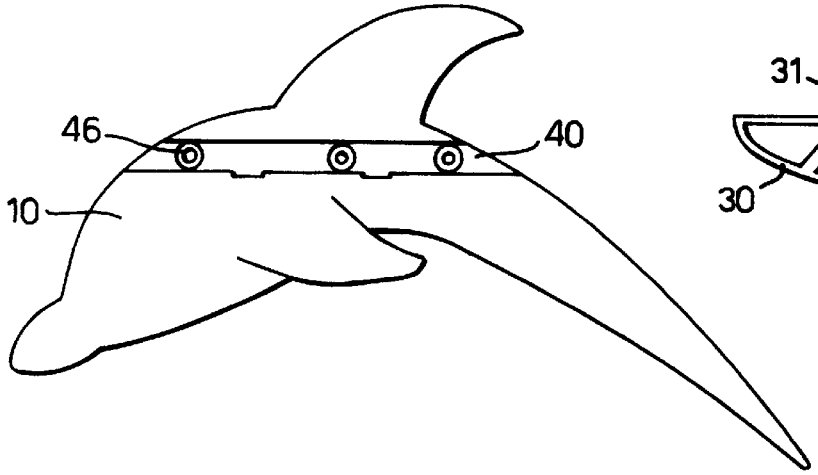
FIG. 15 is a front plan view of get another bracket according to the present invention.
Figure 16:
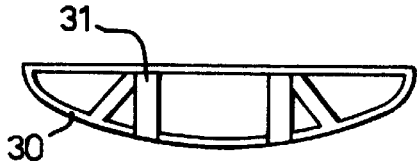
FIG. 16 is a side view of a wedge for use with the bracket of FIG. 15.
Figure 17:
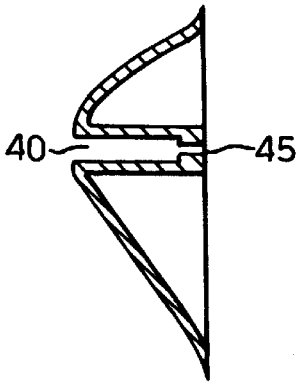
FIG. 17 is a cross-section side view of the bracket of FIG. 15.
Figure 18:
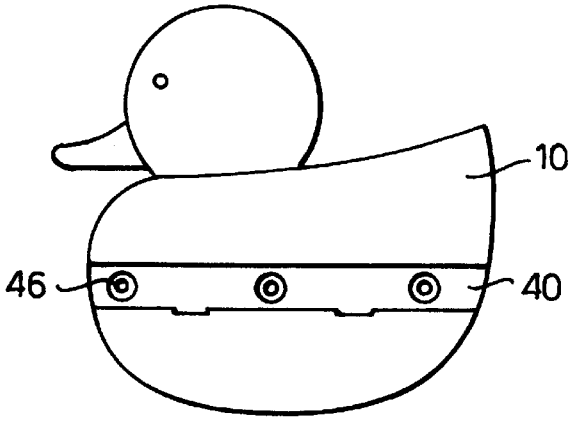
FIG. 18 is a front plan view of yet another bracket according to the present invention.
Figure 19:
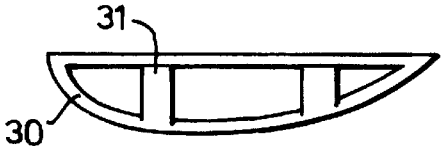
FIG. 19 is a side view of a wedge for use with the bracket of FIG. 18.
Figure 20:
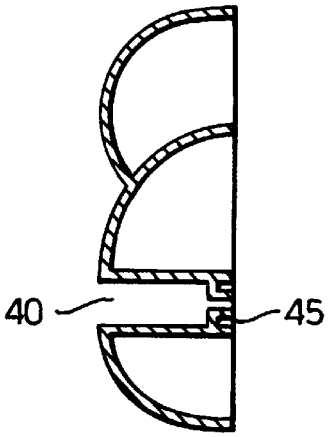
FIG. 20 is a cross-sectional side view of the bracket of FIG. 18.

With particular reference to FIG. 3, the wedge 30 has a longitudinal locating ridge 31 formed along the centre of the wedge 30. A corresponding longitudinal locating groove 71 is formed in the lower jaw 70.

With particular reference to FIG. 6, the wedge 30 has a thin end 34 and a thick end 35. At the thick end 35 a transverse locating ridge 37 and a downwardly sloping end portion extend transversely across the longitudinal locating ridge 31. The open end portion 72 of the lower jaw 70 has a corresponding transverse locating groove 73 and a downwardly sloping portion 74. which extend transversely across the longitudinal locating groove 71.

The perimeter 32 of the wedge 30 is shaped to correspond to the cross-sectional shape of the main part 20 adjacent the lower jaw 70 such that when the wedge 30 is correctly fitted into the slot 40, its perimeter wall 32*a* (see FIG. 1) is flush with the external walls 25. 20 of the main part 20 of the bracket 10.

In order to assemble and mount the shelf unit 1, the main part 20 of the bracket or brackets 10 are firstly mounted, to the wall, etc. onto which the shelf unit is to be mounted, by means of suitable conventional fastening means such as a rawl plug driven through the fixing aperture 46. Once the main part 20 has been mounted, the shelf board 5 is inserted into the slot 40. If extra support blocks 60 are being used these should be attached to the shelf board 5, prior to inserting it into the slot 40. In order to secure the shelf board 5 firmly within the slot 40 the wedge 30 is also inserted into the slot 40, between the lower jaw 70 and the board 5, the thin end 34 leading, and is then tapped into place. The various longitudinal and transverse locating ridges act to ensure that the wedge 30 is correctly fitted so as to end up flush with the main part 20 of the bracket 10. If extra support blocks 60 are being used these are then mounted to the wall, etc. as well.

FIGS. 8 to 26 show different possible designs for the bracket 10. In each case tho assembly principles air substantially the same as for the bracket 10 shown in FIGS. 1 and 3 to 7 and similar elements have been designated with the same reference numeral.

Figure 26:
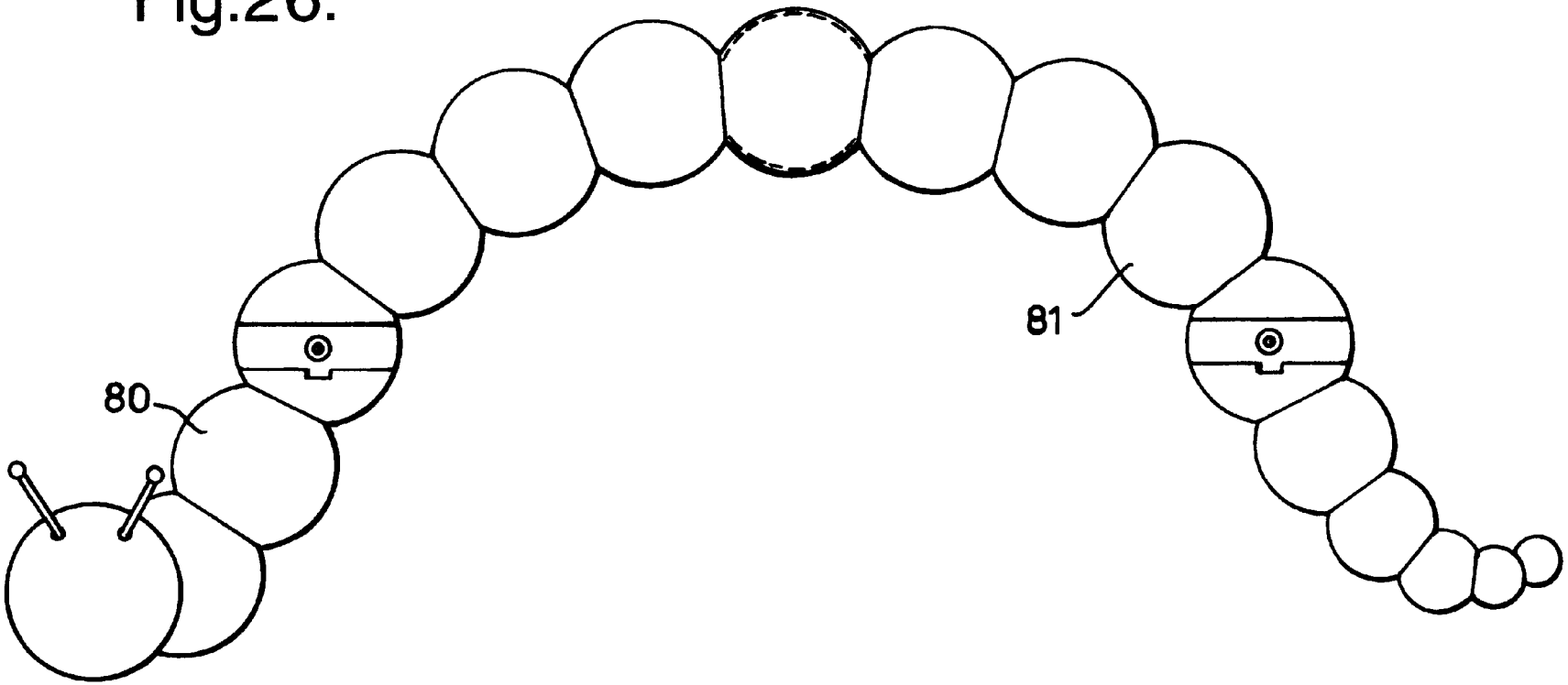
FIG. 26 is a front plan view of the two parts of the bracket connected together.

In FIGS. 22 to 26 a "Caterpillar" shelving unit is shown that is constructed from two brackets 80,81 which are secured together to from a single unit. Each of the two brackets 80,81 consists of a plurality of segments connected together to form part of the body of tho caterpillar. The First of the two brackets an includes the head of the caterpillar 82 which preferably item two resilient projecting antennas 83. The segment 84 approximately half-way along the bracket 80 includes a slot 40 for receiving the shelf board (not shown) and the wedge 30. The usual reciprocating groove and ridge on the slot and wedge respectively are also provided. At tho opposite end of the bracket 80 is a connecting segment 85 for connection to the second part of the caterpillar 81. The connection 86 between the two halves of the caterpillar shelving unit permits the two halves to be orientated with respect to each other at different angles. As seen in FIG. 26 the two halves 80,81 may be orientated so that the slots are aligned to receive a common shelf board. Alternatively, the two halves may be arranged so that each slot receives a separate shelf board that are positioned at different heights. Support blocks (not shown) may be used to provide additional support for the shelf boards.

Although the bracket 10 is ideally made from rigid plastics material, alternative materials may be used, for example wood or MDF. Also, although the extra support blocks 60 are shown as supporting the underneath side of the board 5 so as to be substantially invisible when the shelf unit 1 is viewed from above, they could be inverted so as to be substantially invisible when the shelf unit 1 is viewed from below.

We claim:

1. A shelving system comprising a shelf board; at least one bracket, the at least one bracket including a main body having a front surface with a slot formed therein with a predefined width across said surface adapted to loosely receive the shelf board; and an insert having a perimeter wall for insertion into the slot between a slot wall and the shelf board such that the perimeter wall is outwardly facing for holding the shelf board in place within the slot, the insert and the slot including one or more co-operable projections and recesses for retaining the insert at a predetermined position such that the insert perimeter wall is flush with the front surface of the main body of the bracket across the width of said slot.

2. A shelving system as claimed in claim 1, wherein the at least one bracket includes attachment means for securing the bracket to a support.

3. A shelving system as claimed in claim 2, wherein the attachment means consistent of at least one aperture extending through the bracket for receiving a fastening device.

4. A shelving system as claimed in claim 1, wherein the at least one bracket has attachment means which includes at least one aperture for securing the bracket to a support, a front opening to the aperture being located within the slot whereby the attachment means is hidden from view when the shelf board is mounted in the slot.

5. A shelving system as claimed in claim 4, wherein a recess is provided about the front opening to the aperture to receive the head of a fastening device.

6. A shelving system as claimed in claim 1, wherein one or more co-operable locating ridges and grooves are provided on the insert and the slot for ensuring lateral alignment of the insert in the slot.

7. A shelving system as claimed in claim 6, wherein the co-operable locating ridges and grooves are aligned with the direction of insertion of the insert into the slot.

8. A shelving system as claimed in claim 1, further including one or more support blocks each support block including first attachment means for securing the block to the support and second attachment means for securing the block to the shelf board.

9. A shelving system as claimed in claim 8, wherein the second attachment means is positioned so as to be hidden when the shelf board is secured to the support block.

10. A shelving system as claimed in claim 1, wherein the perimeter wall of the insert is contoured to define a continuous surface with the front surface of the bracket.

11. A shelving system as claimed in claim 1, wherein the insert is tapered to form a wedge with the larger thickness adjacent the perimeter wall of the insert.

12. A shelving system as claimed in claim 1, wherein the slot is tapered so as to narrow towards to rear of the bracket.

* * * * *